US006854304B2

(12) United States Patent
Linares

(10) Patent No.: US 6,854,304 B2
(45) Date of Patent: Feb. 15, 2005

(54) PADDLE LOCK

(75) Inventor: Rodolfo Linares, Whittier, CA (US)

(73) Assignee: S.P.E.P. Acquisition Corporation, Rancho Dominguez, CA (US)

( * ) Notice: Subject to any disclaimer, the term of this patent is extended or adjusted under 35 U.S.C. 154(b) by 23 days.

(21) Appl. No.: 10/277,522

(22) Filed: Oct. 22, 2002

(65) Prior Publication Data

US 2004/0074267 A1 Apr. 22, 2004

(51) Int. Cl.[7] ..... E05B 13/10

(52) U.S. Cl. ..... 70/208; 70/215; 70/224; 292/DIG. 31

(58) Field of Search ..... 70/208, 209, 210, 70/215, 224, DIG. 31; 292/DIG. 31

(56) References Cited

U.S. PATENT DOCUMENTS 4,320,642 A * 3/1982 Pastva, Jr. ..... 70/472
5,299,844 A * 4/1994 Gleason ..... 292/240
5,439,260 A * 8/1995 Weinerman et al. ..... 292/48
5,450,734 A * 9/1995 Esaki et al. ..... 70/208
5,452,596 A * 9/1995 Yamada ..... 70/208
5,611,224 A * 3/1997 Weinerman et al. ..... 70/208
5,820,174 A * 10/1998 Parikh et al. ..... 292/126
5,941,104 A * 8/1999 Sadler ..... 70/208
5,983,682 A * 11/1999 Parikh ..... 70/208
5,984,383 A * 11/1999 Parikh et al. ..... 292/121
6,240,752 B1 * 6/2001 Larsen et al. ..... 70/208
6,427,501 B2 * 8/2002 Ramsauer ..... 70/208
6,454,321 B1 * 9/2002 Parikh ..... 292/216
6,490,896 B2 * 12/2002 Segawa ..... 70/208
6,513,353 B1 * 2/2003 Weinerman et al. ..... 70/208
6,564,764 B2 * 5/2003 Karbstein et al. ..... 123/90.48
6,668,602 B2 * 12/2003 Graham et al. ..... 70/208

* cited by examiner

*Primary Examiner*—John B. Walsh
(74) *Attorney, Agent, or Firm*—Christie, Parker & Hale, LLP

(57) ABSTRACT

A paddle lock. The paddle lock has a housing with a well, a lock with locked and unlocked positions that is attached to the housing and a cam connected to the lock with the cam having a locking portion and an unlocking portion. A cam spring biases the cam to the locking position and the lock to the locked position. A handle is movably connected to the housing between which biases the handle to the opened position flipped out of the well. An actuator is moved by the handle and has a lock position contact portion and an open position contact portion. The handle will move to the opened position where it is out of the well when the lock is open and by pushing the handle down, will cause the lock to turn to its locked position.

23 Claims, 12 Drawing Sheets

PADDLE LOCK

BACKGROUND OF THE INVENTION

This invention relates to the field of latches and locks, and more particularly to a paddle lock.

Paddle locks are used in a variety of different applications where it is desirable to have a lock that mounts generally flush to the surface of the structure. Paddle latches are used for storage containers, cabinet doors, and the like.

Paddle locks have a housing with a well, a handle at least partially positioned in the well, a lock fixed to the housing, and an actuating structure which is moved to an open position when the handle is flipped to an open position, and moved to a closed position when the handle is returned to a closed position. The housing is mounted within an aperture in the mounting structure.

One problem with all locks, including paddle locks, is that it is often difficult to visually determine whether the lock is in the locked or unlocked position. Users will often check the locked/unlocked status of a paddle lock by trying to flip open the handle. Since multiple paddle locks are used in many applications (such as in trucks with multiple storage compartments), it would be desirable to have a paddle lock that provides a visual indicator readily detectable from a distance as to the locked/locked status of the paddle lock.

SUMMARY OF THE INVENTION

The invention provides a paddle lock that provides visual feedback as to the locked/unlocked status from a distance.

The invention further provides a paddle lock with a handle that flips open when the lock is in the unlocked position, and that automatically locks when the handle is pushed closed.

The invention further provides a paddle lock that can be used with a variety of latching mechanisms.

The paddle lock of the invention has a housing with a well that is formed in a front face thereof. The well has side walls and a back wall, and the well is surrounded by a rim portion. A handle is pivotally positioned in the well along an axis of rotation. Stud bolts passing through the well behind the handle can be used to retain the paddle lock to a structure. Other means to attach the housing to the structure can be used. The handle has a front face, a finger grip area behind the front face, and side edges. A handle spring biases the handle to a flipped open position such that the handle is moved outwardly from the well of the housing. A single pivot pin or two pivot pins pass through the side walls of the well from the rear face of the housing and are unrotatably retained to the sides of the handle. The pivot pins may be unrotatably attached to the sides of the handle by virtue of having non-round apertures formed in the sides of the handle and providing pivot pins with a complementary non-round pin profile, at least in the area where the pins are inserted into the sides of the handle.

An actuator is unrotatably fitted on the pin on the outside of one side wall of the well. The actuator has a lock position contact surface, an open position contact surface, and a lever actuating portion. A lock cylinder, such as a keyed lock cylinder, is attached to the housing with its keyed end exposed at the front face of the housing. The housing can have a barrel portion extending behind the back of the housing into which the lock body is inserted. A rotatable end of the lock cylinder extends through the barrel portion. A cam is attached to the rotatable end of the lock cylinder, such as with a screw. The screw can also be used to prevent the lock cylinder from being withdrawn from the barrel. The cam has a curved perimeter portion and an end which terminates in a stop surface. The cam is spring loaded (for example with a torsion spring) so as to bias the lock and the affixed cam to the locked position. A lever is moveably attached to the back of the housing and is moved when the lever actuating portion of the actuator pushes on an actuator contact of the lever. The lever is spring loaded.

The paddle handle operates in the following manner. In the locked position, the handle is flipped down into the well of the housing. The cam spring biases the lock to the locked position, and in the locked position the actuator's lock position contact surface rides on the curved perimeter portion of the cam, and the handle is prevented from being flipped open. As the lock is opened, the cam is rotated until the curved perimeter portion of the cam is moved out of contact with the actuator's lock position contact surface. Since the handle is no longer prevented from flipping open, the handle spring exerts a turning force on the handle and moves the handle to a flipped open position. At this point, the actuator's open position contact surface will make contact with the cam's stop surface, and thereby maintains the lock in the unlocked position and with the handle in a flipped open position out of the well of the housing. This orientation of the handle relative to the housing is readily visually discernable from a distance and provides a user with immediate and irrefutable feedback that the paddle lock is unlocked.

To activate the lever (and open the lock) and to allow the structure to which the paddle lock is attached to be opened, the user will next flip up the handle further. This causes the actuator to turn further, such that its lever actuating portion will impinge on the lever and cause it to move. This movement of the lever can be used to activate a latch or other device for opening a door, a panel, a lid, and the like. Since the lever itself is spring loaded to bias it in a locking position, and exerts a force that resists further flipping open of the handle unless the handle is lifted up by the user, the latch will remain in the closed position until the user lifts the handle up further to activate the lever. However, even in this position, the handle is flipped out from the well of the housing. When the user closes the door, panel, etc., the lever will move as necessary to lock. This movement of the lever does not cause the position of the handle to move from its flipped up position. To lock the paddle lock, all that the user needs to do is to push the handle back into the well. This causes the actuator to be turned such that its open position contact surface moves out of the path of the cam stop surface and permits the spring loaded cam to turn so that the lock returns to the locked position and the actuator's lock position contact surface will ride on the curved perimeter surface of the cam.

The housing is mounted within an aperture in the mounting structure such that the well portion of the housing extends through the aperture.

DETAILED DESCRIPTION OF THE INVENTION

Figure 1:
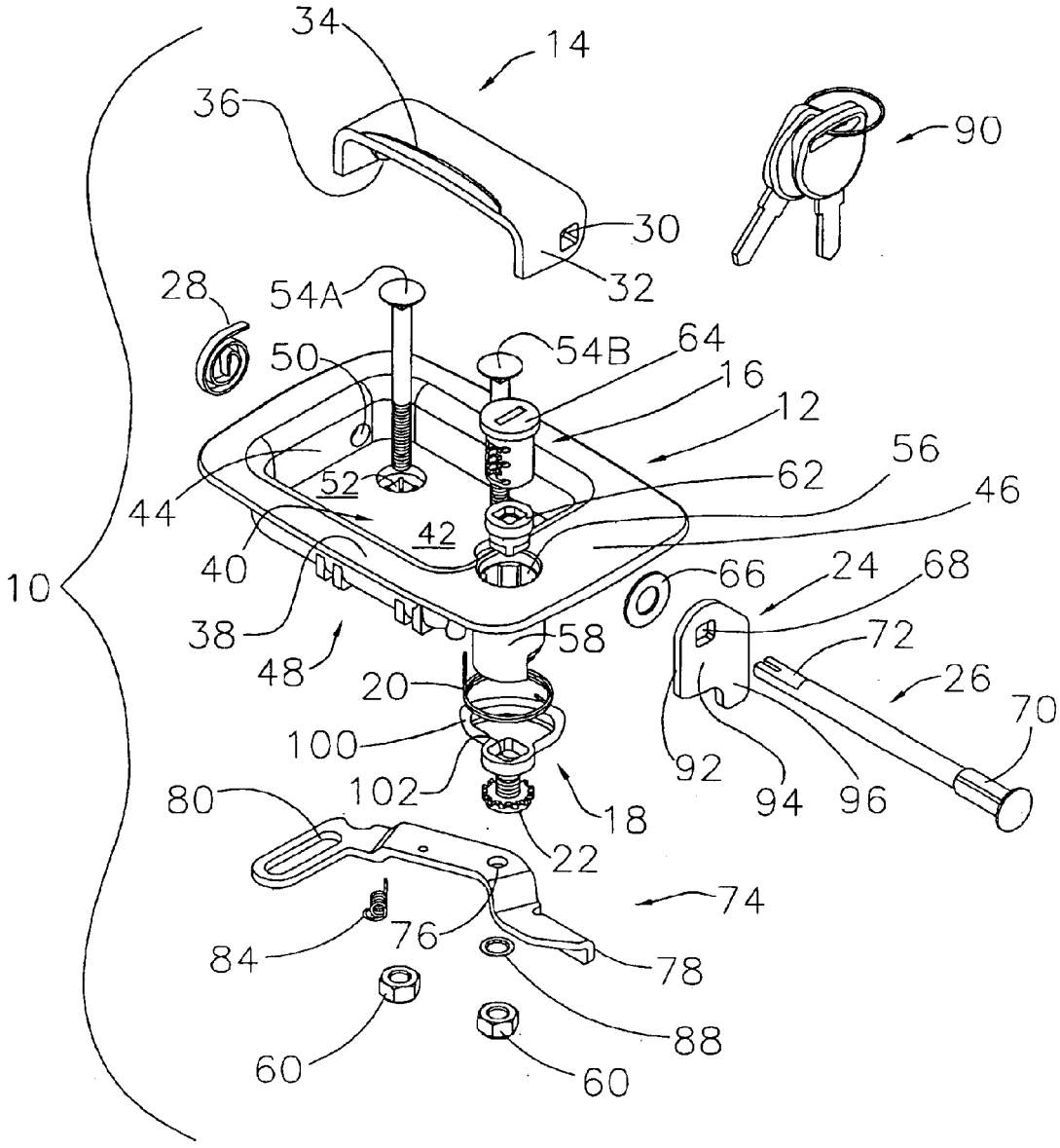
FIG. 1 is an exploded view showing an embodiment of the paddle lock of the invention.

Referring to FIG. 1, an exploded view showing an embodiment of the paddle lock 10 of the invention is shown. The paddle lock 10 has a housing 12, a handle 14, a lock cylinder 16, a cam 18, an actuator 24, and a pivot pin 26. Housing 12 has a front face 38 and has a well 40 formed therein. Well 40 has a bottom 42, side walls 44, and a rim 46 that surrounds the well. Opposite the front face is a back 48 of the housing. Pin apertures 50 are formed in side walls 44. Well apertures 52 can be formed in bottom 42 of well to receive housing bolts 54A and 54B. Other means to attach the housing to the structure with which the paddle lock is attached. A lock aperture 56 is formed in housing, for example on rim 46. A hollow barrel portion 58 can be provided to extend behind face 38 of housing portion for receipt of lock cylinder 16. Housing bolt nuts 60 can be used to retain paddle lock affixed to a structure (not shown). An optional lock extension 62 can be provided for attachment to cylinder lock and both are placed through lock aperture 56 and into hollow barrel portion 58. Lock cylinder has a lock cylinder face 64 which is accessible from front face 38 of housing. A cam screw 22 passes through a cam aperture 102 and is used to connect cam 18 to lock cylinder 16. Cam aperture 102 is preferably out of round and is fitted to the end of lock extension so as to positively turn as cylinder lock is turned. Cam screw 22 can be used to also prevent lock cylinder 16 from being withdrawn from hollow barrel portion 58. A cam spring 20 rides on cam 18 and exerts a twisting force on cam 18 and its attached lock cylinder 16 which tends to bias them to their locked position as shown in FIGS. 2–6.

Figure 4:
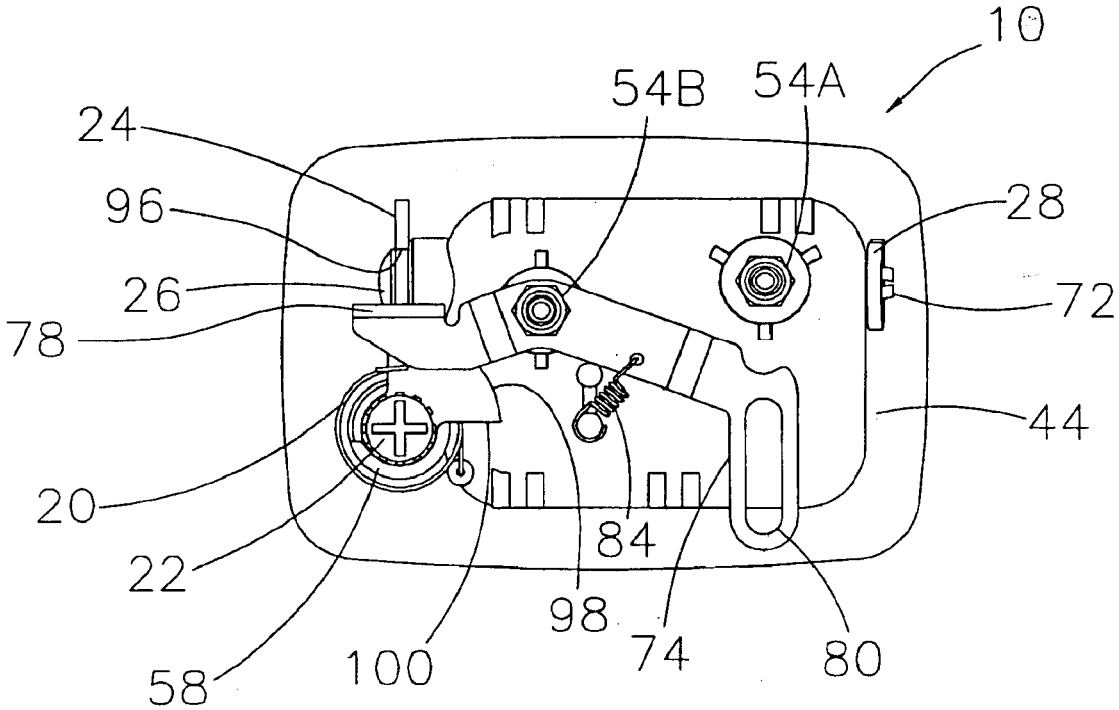
FIG. 4 is a rear plan view showing the paddle handle of FIG. 2 in its locked position.

Handle 14 is pivotally positioned in well 40 along an axis of rotation. Handle 14 has sides 32 with handle apertures 30 formed therethrough, a front 34, and a back side 36. When assembled, pivot pin 26 passes through an aperture 68 in actuator 24, through an actuator spacer 66 and first pin apertures 50 in side wall 44 of well, through handle apertures 30 and through second pin apertures 50 in side wall 44 of well. A handle spring 28 can be conveniently fitted to a handle spring engagement portion 72 of pivot pin, and when in place, will exert a twisting force on pivot pin 26 which acts to bias handle such that tends to be rotated out of well 40. While a spiral spring 28 is shown, other kinds of springs, an elastomer and the like, and their placement can be modified. Spring 28 is used to bias handle 14 to a flipped open position such that the open end of handle is moved outwardly from the well of the housing. Handle apertures 30 can be out of round and be unrotatably engagable with keyed areas of pivot pin 70 and 72. Alternately, pivot pin 26 can be press fit, welded, glued, etc., to handle to prevent pivot pin 26 from rotating relative to handle apertures 30. A lever 74 is moveably attached to the back of the housing on a pivot 76 and has an actuator contact 78 at one end and a locking end 80 at the other end. Turning to FIG. 4, lever spring 84 is provided to bias lever 74 to its locked position. A lever retainer, such as a push on nut 88, lock bolt, etc., rotatably maintains lever on housing. A key 90 is used with lock cylinder 16.

Actuator 24 has a lock position contact surface 92, an open position contact surface 94, and a lever actuating portion 96. Cam 18 has a curved perimeter portion 98 (or locking portion) and a stop surface 100 (unlocking portion). The cam is spring loaded (for example with a torsion spring) so as to bias the lock and the affixed cam to the locked position.

Figure 2:
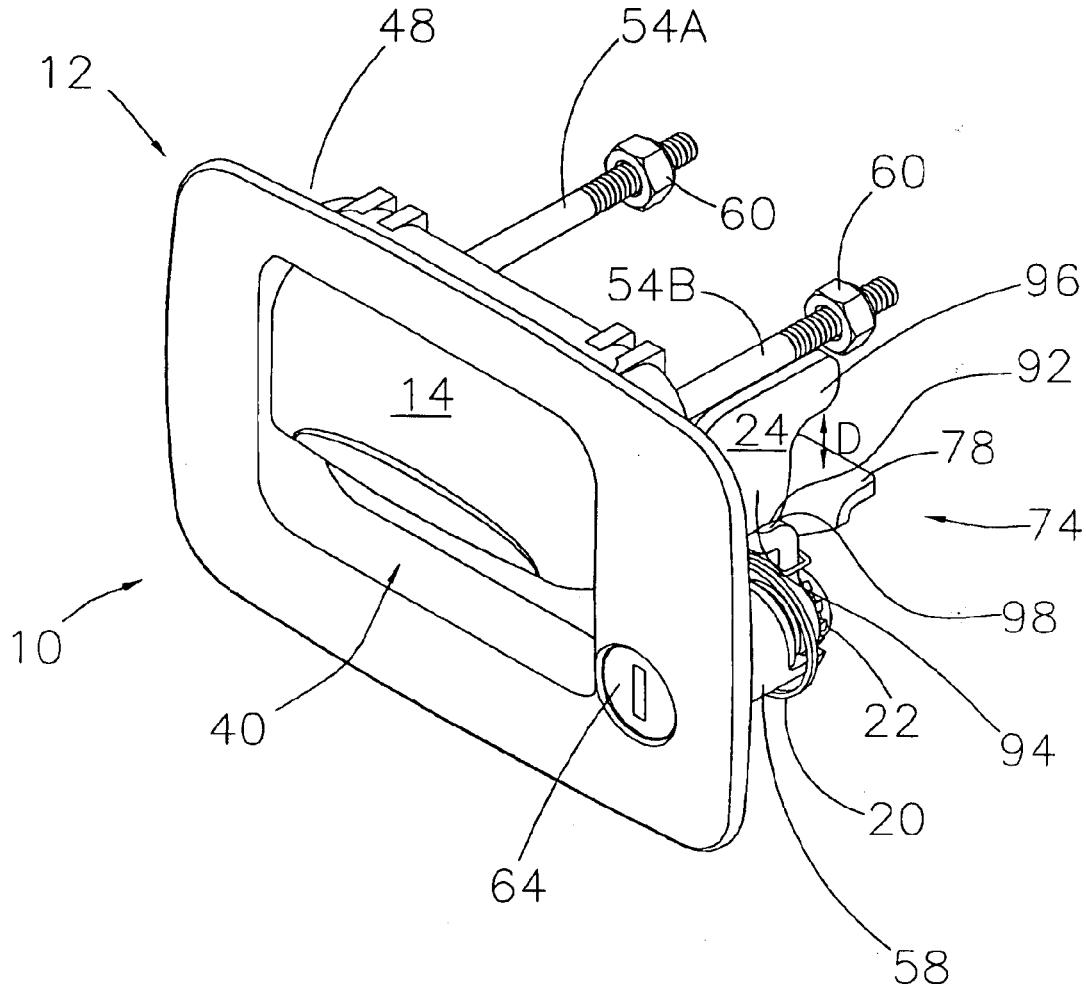
FIG. 2 is a front perspective view of the assembled paddle lock of FIG. 1 in its locked position.

FIG. 2 is a front perspective of the assembled paddle lock 10 of FIG. 1 in its locked position, with handle 14 retained within well 40. Lock cylinder face 64 is in its locked position. Actuator 24 is in its locked position such that lock position contact surface 92 of actuator 24 rides on curved perimeter portion 98 of cam 18. This prevents handle 14 from being flipped open from its locked position. Cam spring 20 biases cam 18 and cylinder lock 16 so that cylinder lock 16 is rotated to this position absent a counteracting turning force applied by key 90 to cylinder lock 16. In this position, actuator's lever actuating portion 96 is separated by a space D from actuator contact 78 of lever, and lever 74 is in its locked position. Housing bolts 54A and 54B are shown extending behind housing 48, and cam screw 22 is shown retaining lock cylinder 16 within barrel portion 58.

Figure 3:
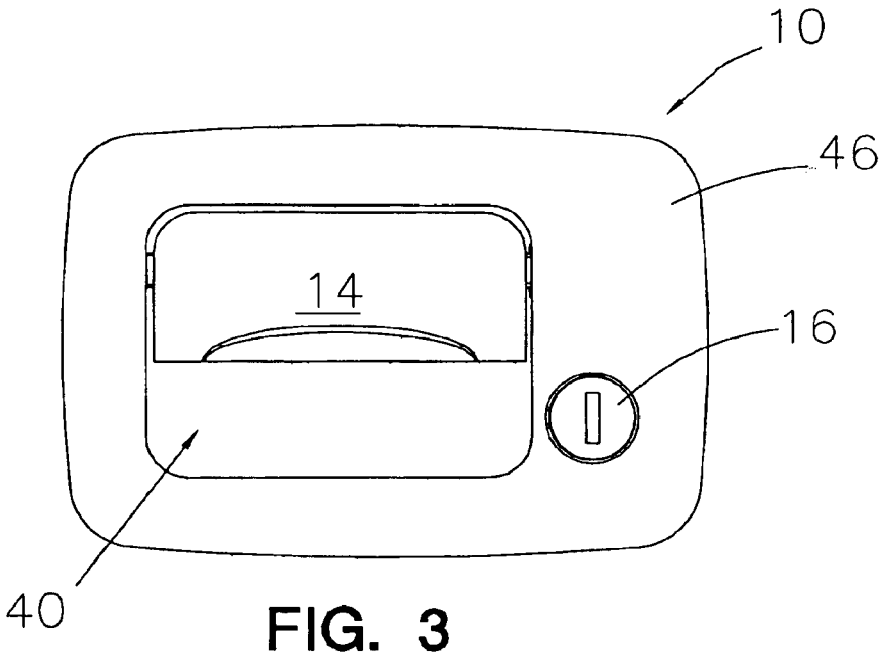
FIG. 3 is a front plan view showing the paddle handle of FIG. 2 in its locked position.

FIG. 3 is a front plan view showing paddle handle 10 in its locked position, with handle 14 flipped down into well 40 and cylinder lock 16 in its locked position.

Figure 5:
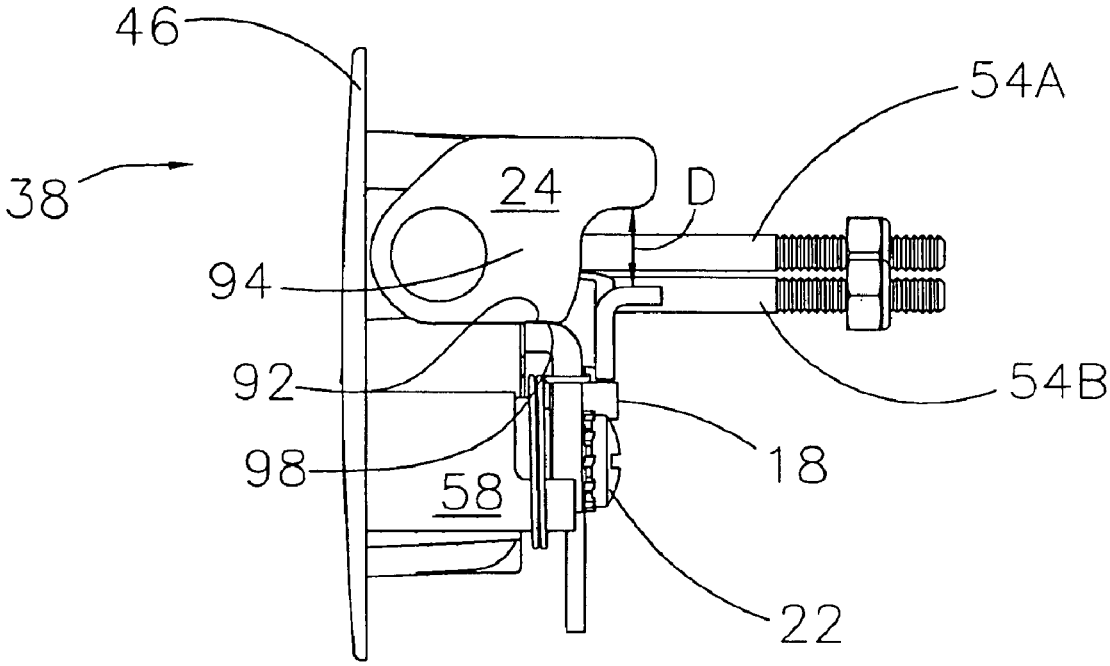
FIG. 5 is a right side view showing the paddle handle of FIG. 2 in its locked position.

FIGS. 4 and 5 show a rear view and right side view of paddle handle 10 of FIG. 2 in its locked position. Pivot pin 26 is shown passing though side walls 44 of well and retains actuator 24 in place. Handle spring 28 is located on handle spring engagement portion 72 of pivot pin. Lever 74 is pivotally attached to housing by having its pivot 76 (which can be an aperture) being placed over housing bolt 54B and is rotatably held in place by lever retainer 88. Actuator 24 is in its locked position such that lock position contact surface 92 of actuator 24 rides on curved perimeter portion 98 of cam 18. This prevents handle 14 from being flipped open from its locked position. Cam spring 20 biases cam 18 and cylinder lock 16 so that cylinder lock 16 is rotated to this position absent a counteracting turning force applied by key 90 to cylinder lock 16. Cam screw 22 is shown retaining lock cylinder 16 within barrel portion 58.

Figure 6:
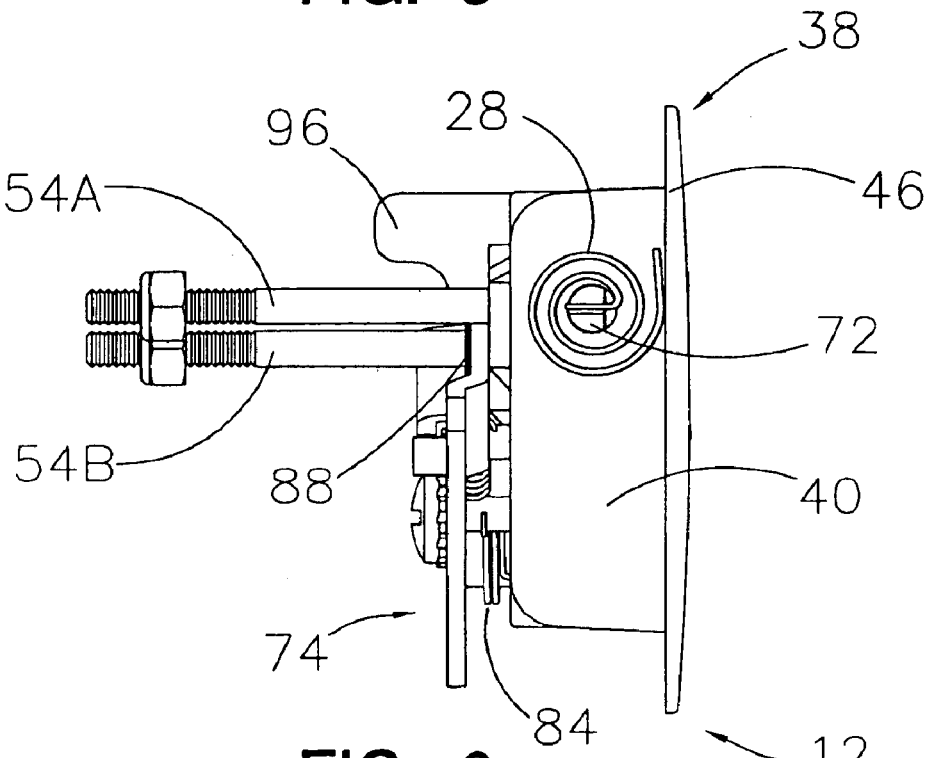
FIG. 6 is a left side view showing the paddle handle of FIG. 2 in its locked position.
Figure 7:
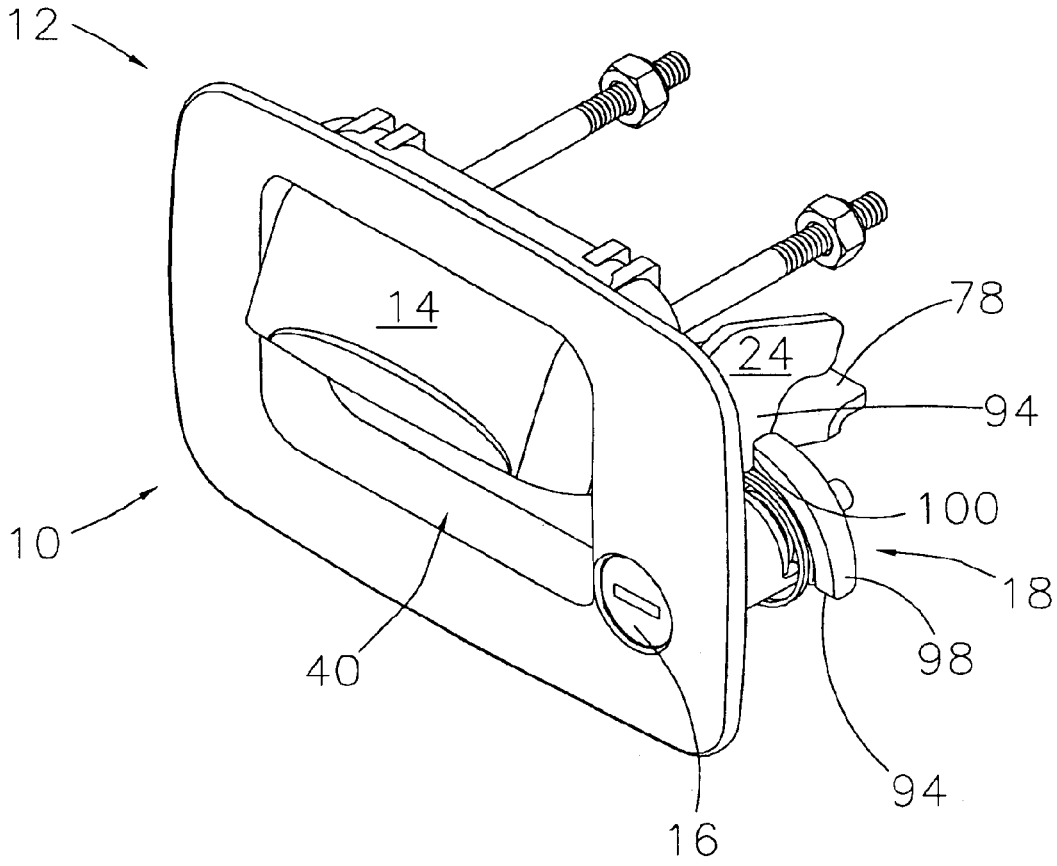
FIG. 7 is a front perspective view of the assembled paddle lock of FIG. 1 in its opened position.
Figure 8:
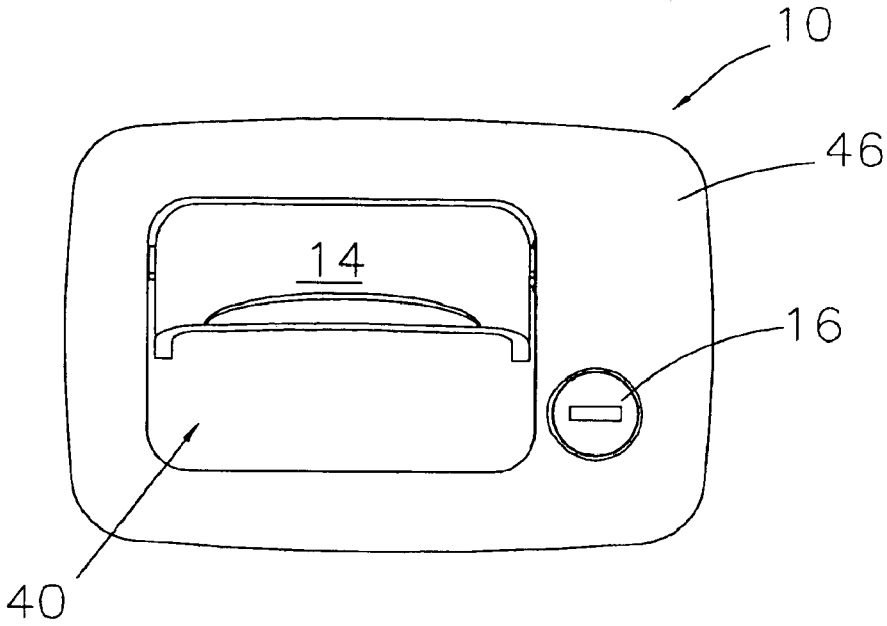
FIG. 8 is a front plan of the assembled paddle lock of FIG. 7, but unlocked with its handle partially flipped open.
Figure 9:
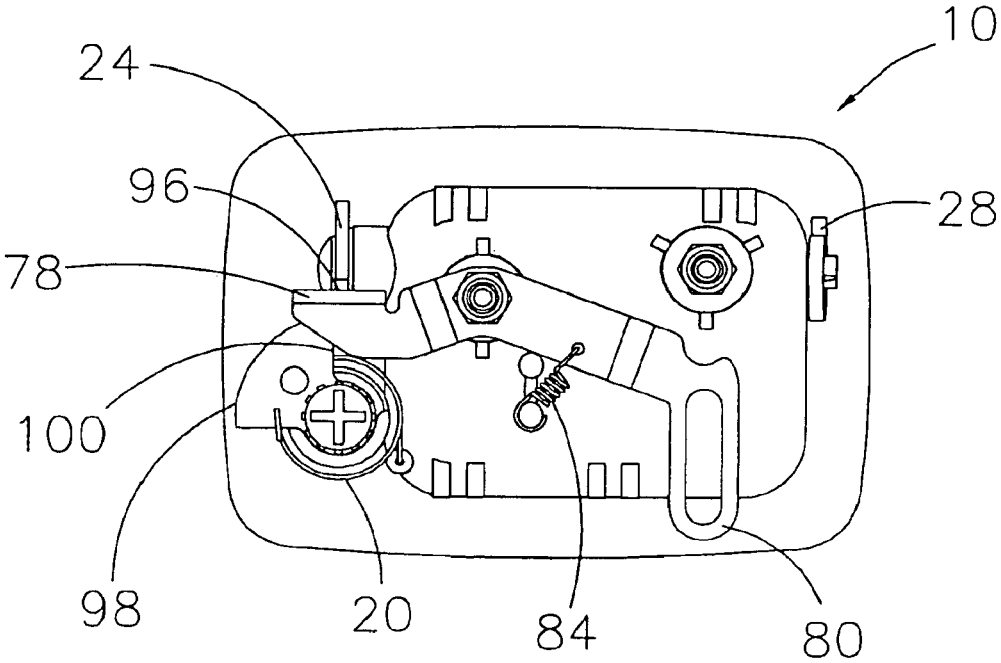
FIG. 9 is a rear plan view of the assembled paddle lock of FIG. 7, but unlocked with its handle partially flipped open.
Figure 10:
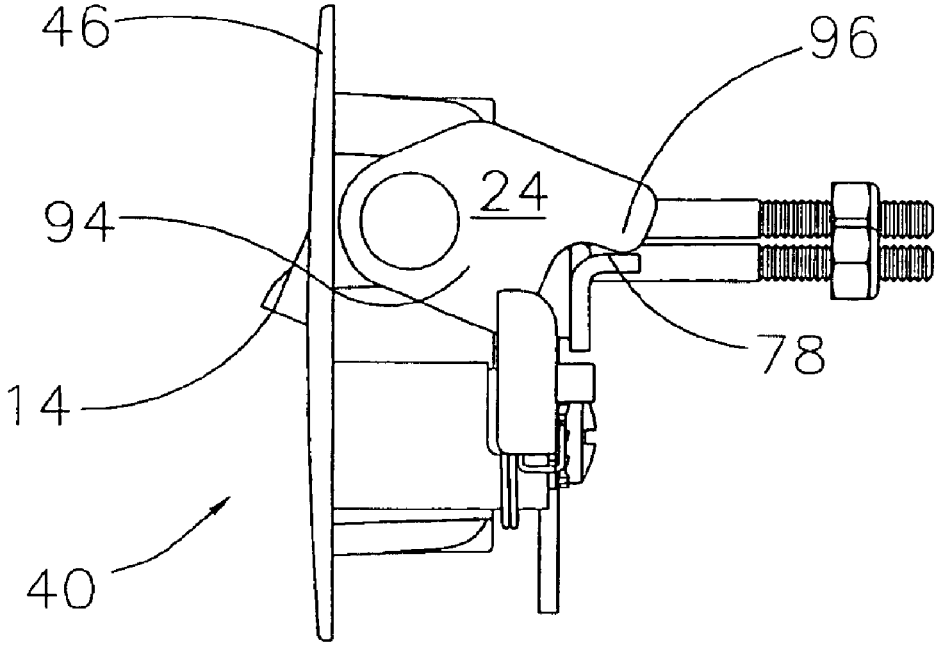
FIG. 10 is a right side view of the assembled paddle lock of FIG. 7, but unlocked with its handle partially flipped open.
Figure 11:
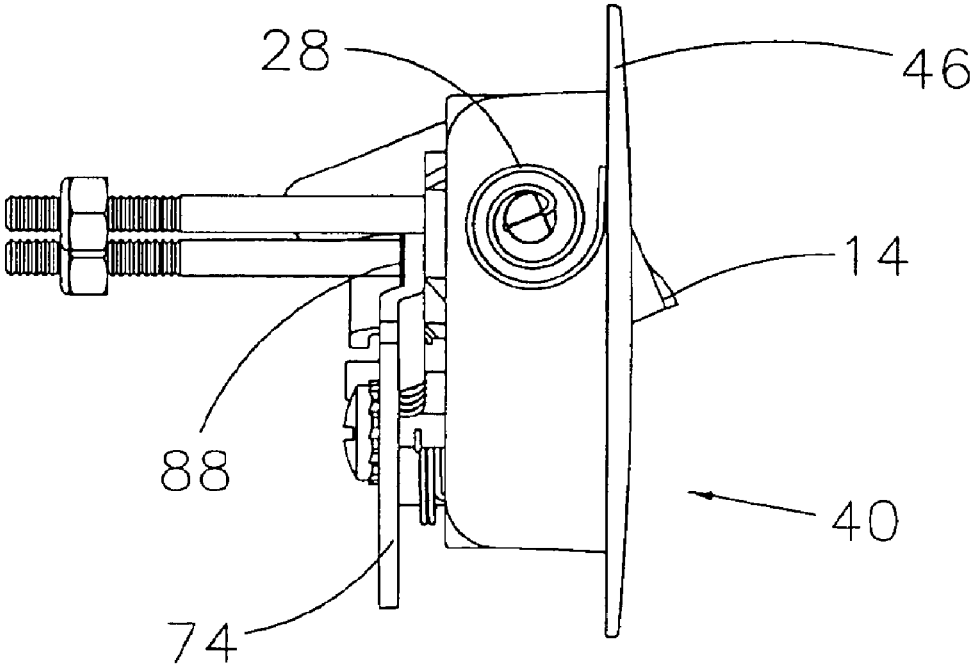
FIG. 11 is a left side view of the assembled paddle lock of FIG. 7, but unlocked with its handle partially flipped open.
Figure 12:
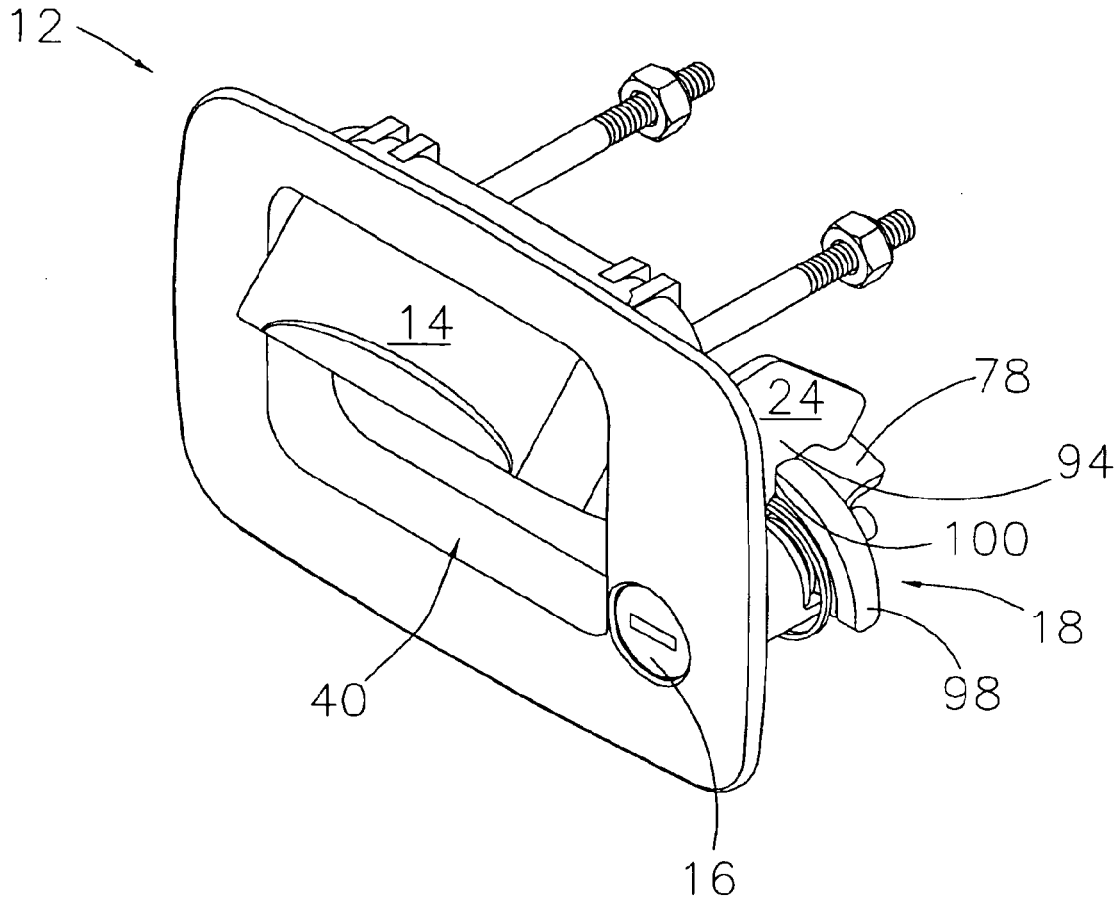
FIG. 12 is a front perspective view of the assembled paddle lock of FIG. 1 in its flipped opened position.
Figure 13:
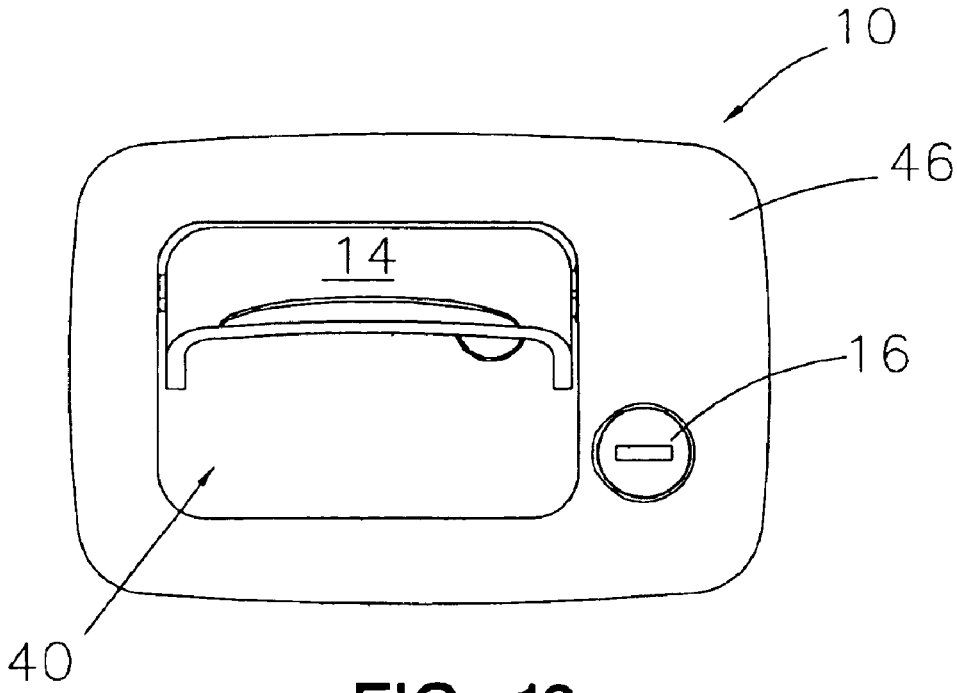
FIG. 13 is a front plan of the assembled paddle lock of FIG. 12, with its handle completely flipped open.
Figure 14:
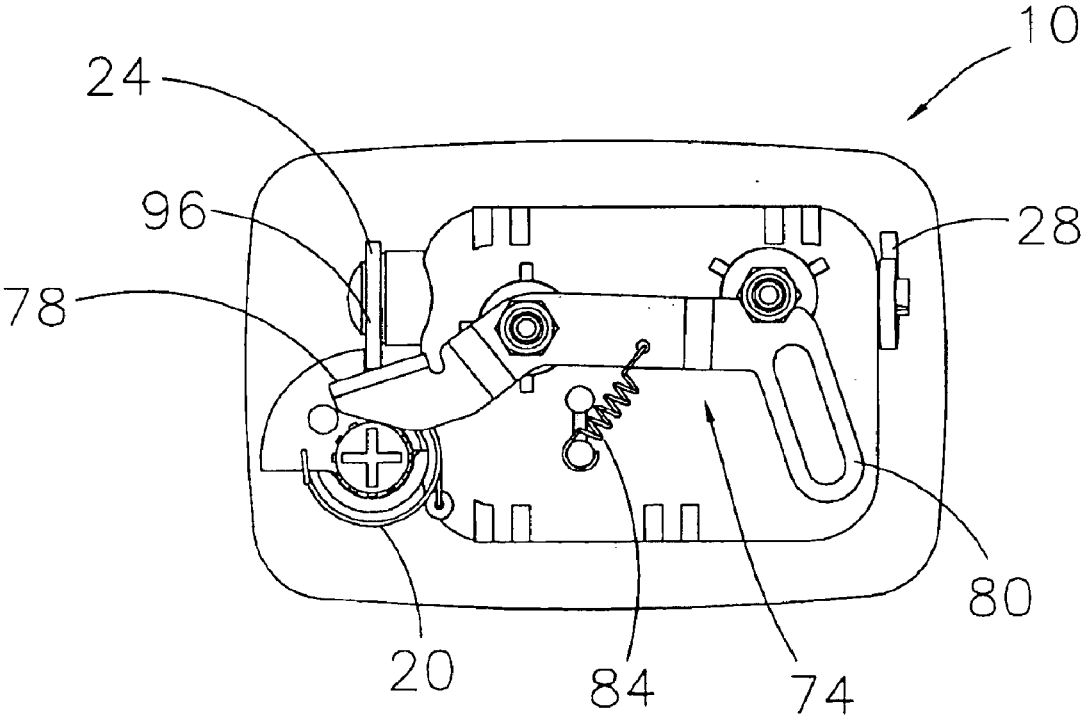
FIG. 14 is a rear plan view of the assembled paddle lock of FIG. 12, with its handle completely flipped open.
Figure 15:
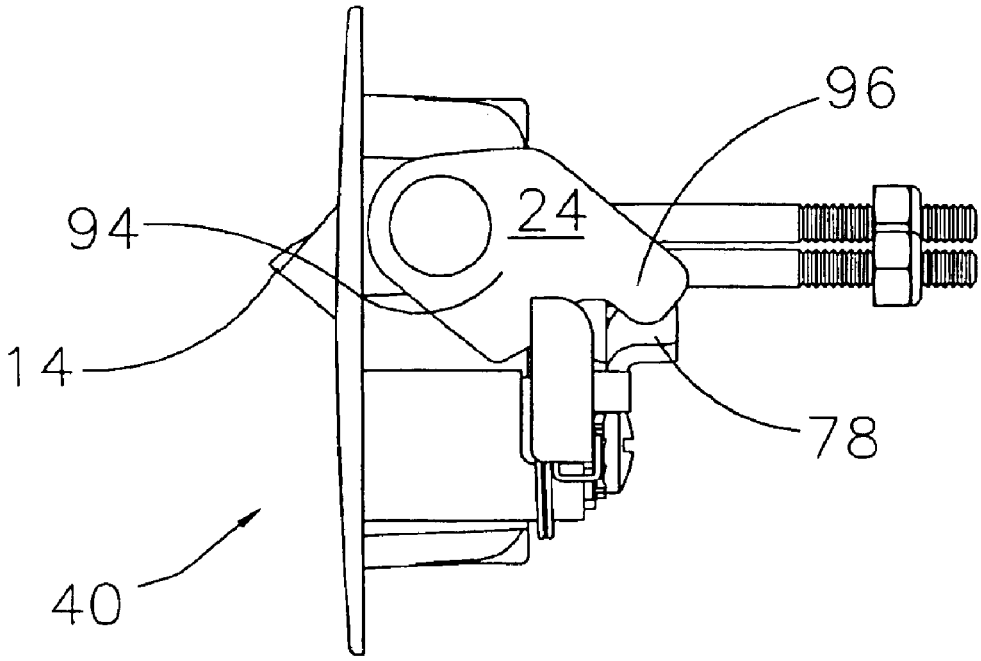
FIG. 15 is a right side view of the assembled paddle lock of FIG. 12, with its handle completely flipped open.
Figure 16:
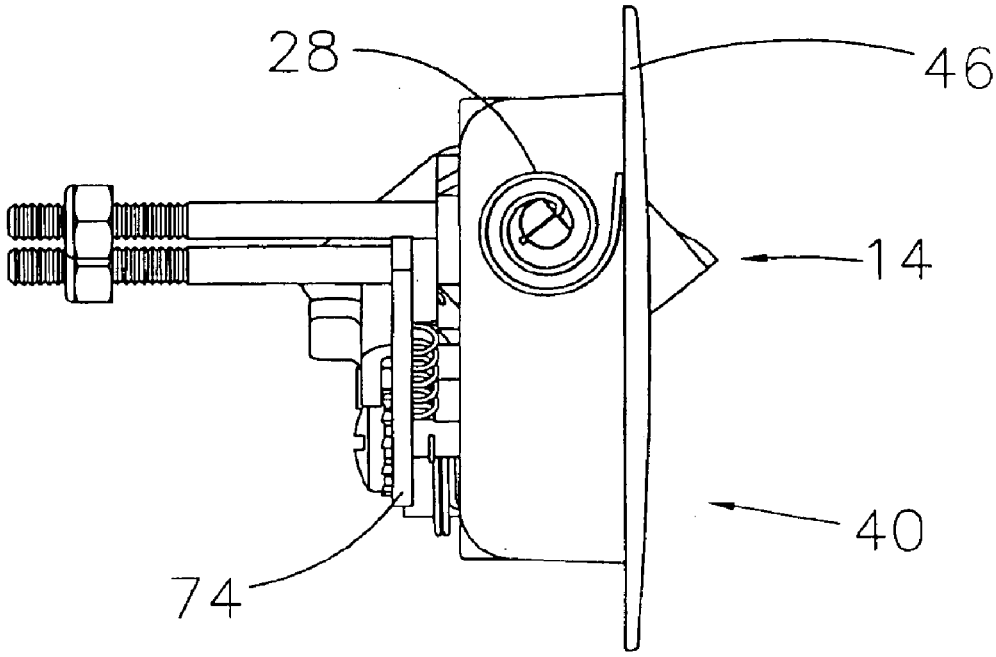
FIG. 16 is a left side view of the assembled paddle lock of FIG. 12, with its handle completely flipped open.

FIG. 6 is a left side view showing the paddle handle of FIG. 2 in its locked position. Handle spring 28 is shown engaged with handle spring engagement portion 72. Handle spring 28 is designed to provide a bias on pivot pin 26 (and thus handle 14, neither shown) which tends to turn handle 14 to a flipped opened position when its open end is moved out of well 40.

FIGS. 7–11 show paddle handle 10 of FIG. 2 in its unlocked position with its handle 14 partially flipped open out of well 40. In this orientation, as key turns lock cylinder 16 , this rotates cam 18 such that curved perimeter portion 98 is moved out of contact with lock position contact surface 92 (not shown) and stop surface 100 of cam moves out of line from actuator. The tension provided by handle spring 28 rotates handle 14 such that actuator 24 is turned so that open position contact surface 94 will provide a surface against which stop surface of cam 18 will contact, and prevent cam 18 and lock cylinder from rotating back to its lock position shown in FIG. 7. In this position, lever actuating portion 96 of actuator 24 will rest on actuator contact 78 of lever 74. The spring force of handle spring and lever spring 84 are selected so that the twisting force exerted on actuator 24 at lever actuating portion 96 is less than the opposing force exerted on actuator contact 78 of lever 74. Thus, in this orientation, handle 14 is partially flipped out of well 40, but lever 74 is not yet moved out of its closed position. However, in this state, the fact that handle 14 is flipped out of well 40 can be seen from a distance, indicating to a user that the paddle lock is unlocked.

FIGS. 12–16 show a back, a front perspective, a right and left side view, respectively, of paddle lock 10 with lever 74 being moved to its opened position flipped out of well 40 position. In this orientation, cam 18 remains in the position such that curved perimeter portion 98 is out of contact with lock position contact surface 92 of actuator 24 and where stop surface 100 of cam is out of line from actuator. By the user lifting up on handle 14 further to overcome the tension exerted on lever 74 by lever spring 84, actuator's lever actuating portion 96 pushed down onto lever's actuator contact 78, which moves lever 74 to its open position shown where it rotates so that its locking end 80 moves to the right and up. However, as soon as the user releases handle 14, the tension provided by lever spring 84 will return it and actuator 24 and handle 14 to their positions shown in FIGS. 7–11.

Figure 17:
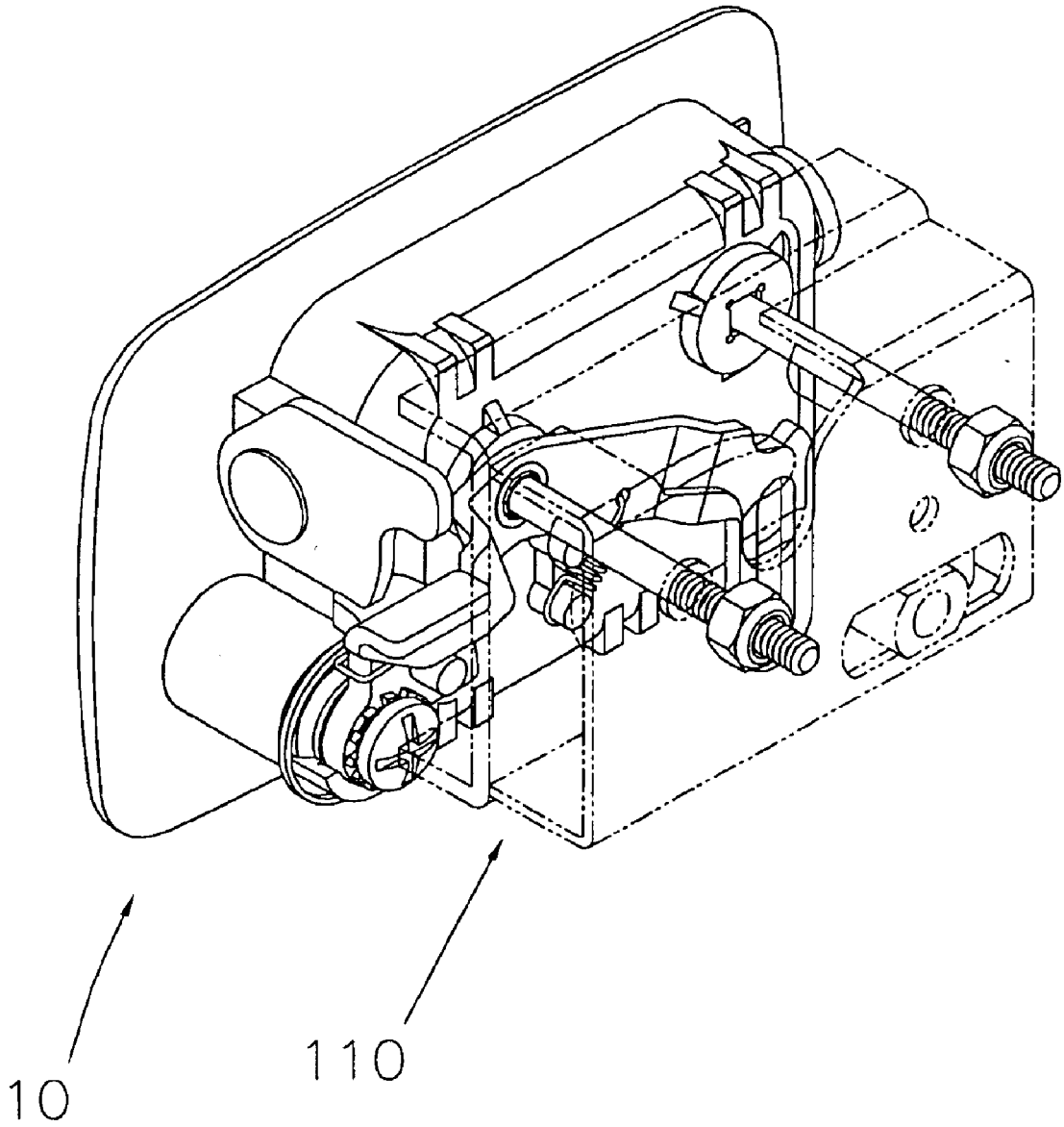
FIG. 17 is a rear view showing the paddle lock of the invention with a latch attached thereto (shown in phantom).

FIG. 17 is a rear view showing paddle handle 10 with a latch 110 (shown in phantom) affixed to a back thereof. Paddle handle 10 and latch 110 will interact with each other.

Figure 18:
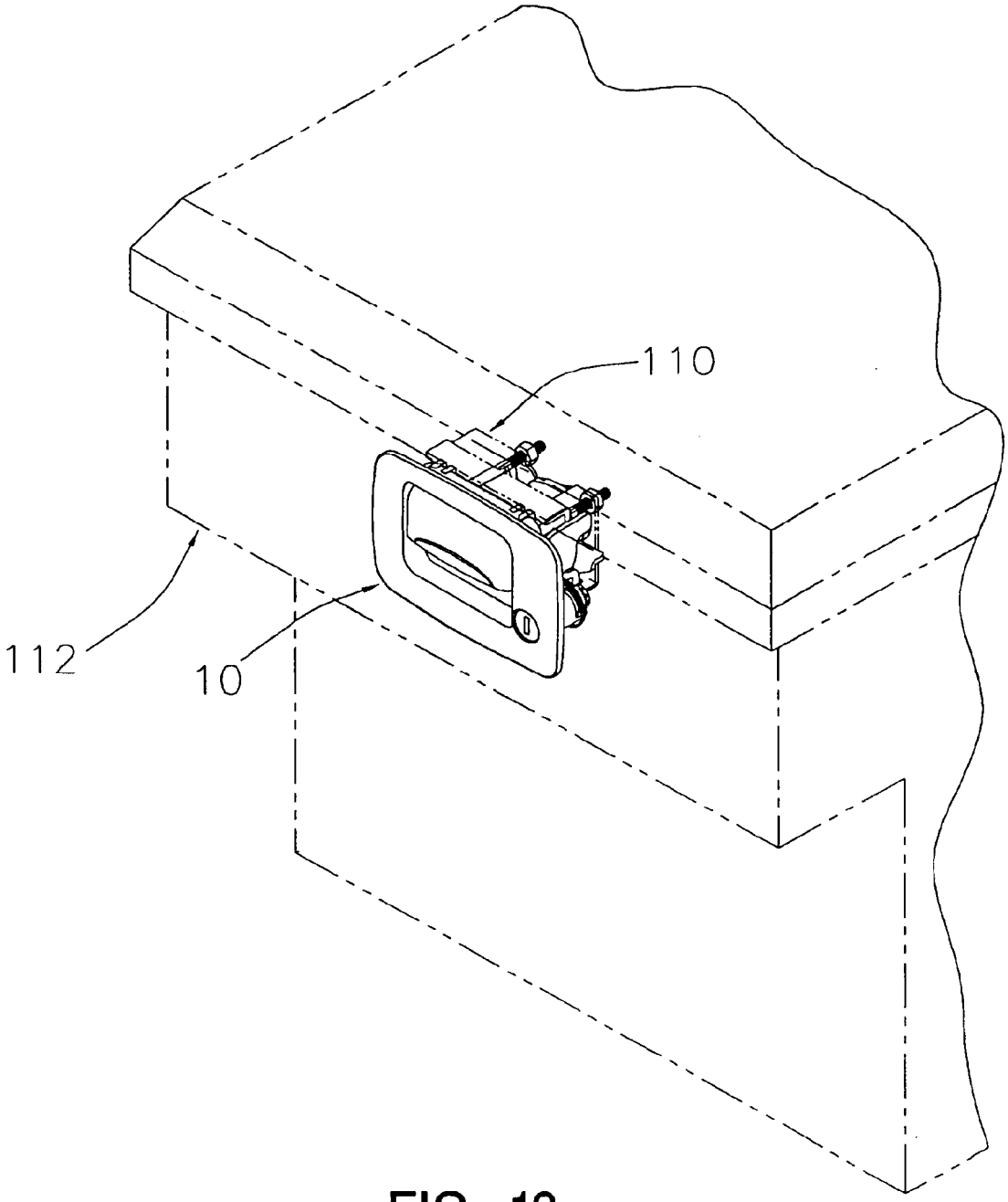
FIG. 18 is a front perspective view showing a paddle handle with a latch attached to a tool box.

FIG. 18 is a front perspective view of paddle handle with latch 110 fitted on an exemplary tool box 112.

Paddle handle 10 operates in the following manner. In the locked position, handle 14 is flipped down into well 40 of housing 12. Cam spring 20 biases cam 18 and cylinder lock 16 to the locked position, and in the locked position actuator's lock position contact surface 92 rides on curved perimeter portion 98 of cam 18, and handle 14 is prevented from being flipped open. As the lock is opened, cam 18 is rotated until curved perimeter portion 98 of cam 18 is moved out of contact with actuator's lock position contact surface 92. Since handle 14 is no longer prevented from flipping open, handle spring 28 exerts a turning force on handle 14 and moves handle 14 to a flipped open position. At this point, actuator's open position contact surface 94 will make contact with cam's stop surface 100, and thereby maintains cylinder lock 16 and cam 18 in the unlocked position and with handle 14 in a flipped open position out of well 40 of housing. This orientation of handle 14 relative to housing is readily visually discernable from a distance and provides a user with immediate and irrefutable feedback that paddle lock is unlocked.

To activate lever 74 (and thereby open paddle lock) and to allow the structure to which paddle lock 10 is attached to and thereby be opened, the user will next flip up handle 14 further. This causes actuator 24 to turn further, such that its lever actuating portion 96 impinges on actuator contact 78 of lever 74 and causes it to move. This movement of lever 78 can be used to activate a latch or other device for opening a door, a panel, a lid, and the like. Since lever 74 itself is spring loaded to bias it in a closed position, and exerts a force that resists further flipping open of handle 14 unless handle 14 is lifted up by the user, latch 110 will remain in the locked position until the user lifts handle 14 up further to activate lever 74. However, even in this position, handle 14 is flipped out of well 40 of housing 12. When the user closes the door, panel, etc., lever 74 is capable of moving as necessary (e.g. rotating so that its lock end 80 moves upwardly towards housing bolt 54A to provide for latching). This movement of lever 74 does not cause the position of handle 14 to move from its flipped up position. To lock paddle lock 10, all that the user needs to do is to push handle 14 back into well 40. This causes actuator 24 to be turned such that its open position contact surface 94 moves out of the path of cam stop surface 100 and permits spring loaded cam 18 to turn so that lock 16 returns to the locked position where the actuator's lock position contact surface 92 will again ride on curved perimeter surface 98 of cam 18. Thus, the paddle lock of the invention provides not only a way to provide visual feedback as to the locked/unlocked state of the lock, but also permits easy locking without needing to use a key. In other words, if handle 14 is flipped up, paddle lock will always be unlocked, and when paddle lock is flipped down completely into well 40, paddle lock is always locked. The design of the paddle lock can provide for a noticeable snapping sound when cam 18 quickly rotates, further giving a user feedback that the paddle lock 10 is truly locked. Indeed, the spring loading handle 14 further provides a force that tends to return and maintain handle in its opened position until handle is pushed down.

The housing is mounted within an aperture in the mounting structure such that the well portion of the housing extends through the aperture.

Although the invention has been described with the handle having a certain shape, any number of shapes of handles and housing, pivot pin or pins, levers, actuators can be provided. Moreover, in lieu of keyed cylinder lock 16, a combination or other type of lock can be used. The drawings in the foregoing description are not intended to represent the only form of the invention in regard to the details of its construction and manner of operation. In fact, it will be evident to one skilled in the art that modifications and variations can be made without departing from the spirit and scope of the invention. Although specific terms have been employed, they are intended in a generic and descriptive sense only and not for purposes of limitation.

What is claimed is:

1. A paddle lock, comprising:

a housing;

a lock, with locked and unlocked positions, attached to the housing;

a cam connected to the lock, the cam having a locking portion and an unlocking portion;

a cam biasing spring which biases the cam to a locking position and the lock to the locked position;

a handle that is movably connected to the housing and has an opened position and a closed position;

handle biasing means which biases the handle to the opened position; and an actuator that is moved by the handle, the actuator having a lock position contact portion and an open position contact portion.

2. The paddle lock of claim 1, further comprising a lever adapted to be moved by the actuator and a lever biasing means to bias the lever to a closed position.

3. The paddle lock of claim 2, wherein the actuator further comprises a lever actuating portion for moving the lever.

4. The paddle lock of claim 1, wherein the handle biasing means is a spring.

5. The paddle lock of claim 1, wherein the housing further comprises a well formed therein and wherein the handle is located at least partially in the well when the handle is in a closed position and wherein more of the handle is moved out of the well when the handle is in an opened position.

6. The paddle lock of claim 1, further comprising at least one pivot pin for pivotally mounting the handle to the housing, wherein the at least one pivot pin rotatably connects the actuator to the handle such that the actuator rotates with rotation of the handle, and connects to the handle biasing means to bias the handle to the opened position.

7. The paddle lock of claim 1, wherein the locking portion of the cam comprises a curved perimeter portion and the unlocking portion comprises a stop surface at an end of the curved perimeter portion.

8. The paddle lock of claim 1, wherein the lock is a keyed locked fit within an aperture formed in the housing.

9. The paddle lock of claim 1, wherein the handle biasing means is a spring.

10. A paddle lock, comprising:

a housing;

a lock, with locked and unlocked positions, attached to the housing;

a cam connected to the lock, the cam having a locking portion and an unlocking portion;

a cam biasing means which biases the cam to a locking position and the lock to the locked position;

a handle that is movably connected to the housing between an opened position and closed portion;

handle biasing means which biases the handle to the opened position;

an actuator that is moved by the handle, the actuator having a lock position contact portion, an open position contact portion, and a lever actuating portion;

a lever adapted to be moved by the lever actuating portion of the actuator; and a lever biasing means to bias the lever to a closed position.

11. The paddle lock of claim 10, wherein the housing further comprises a well formed therein and wherein the handle is located at least partially in the well when the handle is in a closed position and wherein more of the handle is moved out of the well when the handle is in an opened position.

12. The paddle lock of claim 10, further comprising at least one pivot pin for pivotally mounting the handle in the well of the housing further, wherein the at least one pivot pin rotatably connects the actuator to the handle such that the actuator rotates with rotation of the handle, and connects to the handle biasing means to bias the handle to the opened position.

13. The paddle lock of claim 10, wherein the locking portion of the cam comprises a curved perimeter portion and the unlocking portion comprises a stop surface at an end of the curved perimeter portion.

14. The paddle lock of claim 10, wherein the lock is a keyed locked fit within an aperture formed in the housing.

15. A paddle lock, comprising:

a housing with a well formed therein;

a lock, with locked and unlocked positions, fixed to the housing;

a cam connected to the lock, the cam having a curved perimeter portion and a stop surface;

cam biasing means which biases the cam to a locking position and the lock to the locked position;

a handle that is movably connected to the housing and adapted to at least partially move from a closed position in the well to an opened position at least partially out of the well;

handle biasing means which biases handle to the opened position;

an actuator that is moved by the handle, the actuator having a lock position contact portion, an open position contact portion, and a lever actuating portion;

a lever adapted to be moved by the actuator; and a lever biasing means to biases the lever to a closed position;

wherein the actuator's lock position contact portion rides on the curved perimeter portion of the cam when the lock is in the locked position and prevents the handle from being moved, and when the lock is moved to the unlocked position, the handle biasing means moves the handle to the opened position so that the actuator's unlocked position contact portion contacts the stop surface of the cam and prevents the lock from returning to the locked position, and by moving the handle further to counteract the lever biasing means, the lever is moved to an opened position, and by moving the handle to its closed position, the actuator is turned to move the open position contact portion out of contact with the cam's stop surface and the cam biasing means returns the cam to its locking position and lock to its locked position.

16. The paddle lock of claim 15, further comprising at least one pivot pin for pivotally mounting the handle in the well of the housing further, wherein the at least one pivot pin rotatably connects the actuator to the handle such that the actuator rotates with rotation of the handle, and connects to the handle biasing means to bias the handle to the opened position.

17. The paddle lock of claim 15, wherein the locking portion of the cam comprises a curved perimeter portion and the unlocking portion comprises a stop surface at an end of the curved perimeter portion.

18. The paddle lock of claim 15, wherein the lock is a keyed locked fit within an aperture formed in the housing.

19. The paddle lock of claim 18, wherein the aperture formed in the housing comprises a cylindrical portion extending from an rear surface of the housing.

20. A paddle lock which positively indicates the locked or unlocked state of the paddle lock, comprising:

a housing with a well;

a lock, with locked and unlocked positions, attached to the housing;

a handle that is movably connected to the housing between a locked position; and a cam connected to the lock, the cam having a locking portion and an unlocking portion, a cam biasing spring which biases the cam and the lock to the locked position, wherein the handle is largely received in the well, and an unlocked position wherein at least a portion of the handle extends outside of the well;

wherein when the handle is moved to its locked position the lock is moved to its locked position, and when the handle is in its unlocked position, the lock is unlocked.

21. The paddle lock of claim 20, further comprising an actuator that is movable by the handle, the actuator having a lock position contact portion and an open position contact portion.

22. The paddle lock of claim 21, further comprising an spring which biases the handle to its unlocked position.

23. The paddle lock of claim 22, wherein when the handle is in its unlocked position, a user can move the handle further out of the well to operate the actuator.

* * * * *

UNITED STATES PATENT AND TRADEMARK OFFICE

CERTIFICATE OF CORRECTION

PATENT NO. : 6,854,304 B2
DATED : February 15, 2005
INVENTOR(S) : Linares

It is certified that error appears in the above-identified patent and that said Letters Patent is hereby corrected as shown below:

Column 7,
Line 29, delete "keyed locked", insert -- keyed lock --.
Line 38, delete "means", insert -- spring --.
Line 41, after "position and", insert -- a --.

Column 8,
Line 2, delete "keyed locked", insert -- keyed lock --.
Line 21, delete "biases", insert -- bias --.
Line 51, delete "keyed locked", insert -- keyed lock --.
Line 54, delete "an rear", insert -- a rear --.

Column 10,
Line 1, delete "an spring", insert -- a spring --.

Signed and Sealed this

Thirtieth Day of August, 2005

JON W. DUDAS
*Director of the United States Patent and Trademark Office*